US007645552B2

(12) United States Patent
Patel et al.

(10) Patent No.: US 7,645,552 B2
(45) **Date of Patent: *Jan. 12, 2010**

(54) TONER COMPOSITIONS

(75) Inventors: Raj D. Patel, Oakville (CA); Daryl Vanbesien, Burlington (CA); Enno E. Agur, Toronto (CA); Edward G. Zwartz, Mississauga (CA); Maria N. V. McDougall, Burlington (CA); Emily L. Moore, Mississauga (CA); Patricia A. Burns, Milton (CA); Kimberly D. Nosella, Mississauga (CA); Ke Zhou, Mississauga (CA); Vladislav Skorokhod, Mississauga (CA); Wafa F. Bashir, Mississauga (CA); Shigang (Steven) Qiu, Toronto (CA)

(73) Assignee: Xerox Corporation, Norwalk, CT (US)

( * ) Notice: Subject to any disclaimer, the term of this patent is extended or adjusted under 35 U.S.C. 154(b) by 341 days.

This patent is subject to a terminal disclaimer.

(21) Appl. No.: 11/003,581

(22) Filed: Dec. 3, 2004

(65) Prior Publication Data

US 2006/0121384 A1 Jun. 8, 2006

(51) Int. Cl.
*G03G 9/087* (2006.01)

(52) U.S. Cl. ..... 430/109.3; 430/109.1; 430/109.4

(58) Field of Classification Search ..... 430/109.3, 430/109.1, 109.4

See application file for complete search history.

(56) References Cited

U.S. PATENT DOCUMENTS

| | | | |
|---|---|---|---|
| 3,674,736 | A | 7/1972 | Lerman |
| 4,291,111 | A | 9/1981 | Lu |
| 4,935,326 | A | 6/1990 | Creatura |
| 4,937,166 | A | 6/1990 | Creatura |
| 5,278,020 | A | 1/1994 | Grushkin |
| 5,290,654 | A | 3/1994 | Sacripante |
| 5,308,734 | A | 5/1994 | Sacripante |
| 5,344,738 | A | 9/1994 | Kmiecik-Lawrynowi |
| 5,346,797 | A | 9/1994 | Kmiecik-Lawrynowi |
| 5,348,832 | A | 9/1994 | Sacripante |
| 5,364,729 | A | 11/1994 | Kmiecik-Lawrynowi |
| 5,366,841 | A | 11/1994 | Patel |
| 5,370,963 | A | 12/1994 | Patel |
| 5,403,693 | A | 4/1995 | Patel |
| 5,405,728 | A | 4/1995 | Hopper |
| 5,418,108 | A | 5/1995 | Kmiecik-Lawrynowi |
| 5,496,676 | A | 3/1996 | Croucher |
| 5,501,935 | A | 3/1996 | Patel |
| 5,527,658 | A | 6/1996 | Hopper |
| 5,585,215 | A | 12/1996 | Ong |
| 5,650,255 | A | 7/1997 | Ng |
| 5,650,256 | A | 7/1997 | Veregin |
| 5,683,847 | A | 11/1997 | Patel |
| 5,723,253 | A | 3/1998 | Higashino |
| 5,744,520 | A | 4/1998 | Kmiecik-Lawrynowicz |
| 5,747,215 | A | 5/1998 | Ong |
| 5,763,133 | A | 6/1998 | Ong |
| 5,766,818 | A | 6/1998 | Smith |
| 5,804,349 | A | 9/1998 | Ong |
| 5,827,633 | A | 10/1998 | Ong |
| 5,840,462 | A | 11/1998 | Foucher |
| 5,853,944 | A | 12/1998 | Foucher |
| 5,863,698 | A | 1/1999 | Patel |
| 5,869,215 | A | 2/1999 | Ong |
| 5,869,216 | A | 2/1999 | Ong |
| 5,869,558 | A | 2/1999 | Hou |
| 5,902,710 | A | 5/1999 | Ong |
| 5,910,387 | A | 6/1999 | Mychajlowskij |
| 5,916,725 | A | 6/1999 | Patel |
| 5,919,595 | A | 7/1999 | Mychajlowskij |
| 5,925,488 | A | 7/1999 | Patel |
| 5,928,830 | A | 7/1999 | Cheng |
| 5,977,210 | A | 11/1999 | Patel |
| 6,130,021 | A | 10/2000 | Patel |
| 6,294,306 | B1 | 9/2001 | Kmiecik-Lawrynowicz |
| 6,309,787 | B1 | 10/2001 | Cheng |
| 6,326,115 | B1 * | 12/2001 | Nakanishi et al. ..... 430/109.5 |
| 6,413,692 | B1 | 7/2002 | Cheng |
| 6,447,974 | B1 | 9/2002 | Chin |
| 6,576,389 | B2 | 6/2003 | Vanbesien |
| 6,617,092 | B1 | 9/2003 | Patel |
| 6,627,373 | B1 | 9/2003 | Patel |
| 6,638,677 | B2 | 10/2003 | Patel |
| 6,656,657 | B2 | 12/2003 | Patel |
| 6,656,658 | B2 | 12/2003 | Patel |
| 6,664,017 | B1 | 12/2003 | Patel |

(Continued)

OTHER PUBLICATIONS

European Search Report, Application No. 05110807.4, dated Jul. 7, 2006, 7 pages.

(Continued)

*Primary Examiner*—Hoa V Le
(74) *Attorney, Agent, or Firm*—Marylou J. Lavoie, Esq., LLC

(57) ABSTRACT

Toner compositions include a non cross linked resin; a cross linked resin or gel; a wax; and a colorant. Processes for preparing a toner include mixing a non-cross linked resin and a cross-linked resin or gel in the presence of a wax, a colorant, and a coagulant to provide toner size aggregates; adding additional non-cross linked latex to the formed aggregates thereby providing a shell over the formed aggregates; heating the shell covered aggregates to form toner; and, optionally, isolating the toner.

25 Claims, No Drawings

U.S. PATENT DOCUMENTS

| | | | | |
|---|---|---|---|---|
| 6,673,505 | B2 | 1/2004 | Jiang | |
| 6,800,412 | B2 * | 10/2004 | Sugiyama et al. | 430/108.1 |
| 2003/0152859 | A1 * | 8/2003 | Emoto et al. | 430/109.4 |
| 2004/0137357 | A1 | 7/2004 | Bartel et al. | |
| 2004/0146797 | A1 | 7/2004 | Patel et al. | |
| 2004/0202950 | A1 | 10/2004 | Ahuja et al. | |

OTHER PUBLICATIONS

Yoshikunl et al., Method for production of microfine coloured particles and electrophotographic toner using the particles, Published Jan. 29, 1992 Bulletin 92/05, 36 pages, Publication No. 0 468 765 A1, European Patent Application No. 91306742.7.

Livengood et al, Toner Particulates Comprising an Ethylene Propylene Wax, Published Apr. 19, 2001, Publication No. WO 01/27698 Al, 24 pages, International Application No. PCT/US00/27466.

Robert A. Nelson, Toner Compositions, Published Jan. 2, 1992, Publication No. GB 2 245 376 A, 24 pages, Application No. 9111090.8.

Emura et al., Toner Composition and Method for Production Thereof, Published Jan. 2, 2003 Bulletin 2003/01, 29 pages, Publication No. EP 1 271 256 A1, European Patent Application No. 01963513.5.

* cited by examiner

TONER COMPOSITIONS

TECHNICAL FIELD

The present disclosure is generally directed to toner compositions and processes and more specifically directed to toner compositions and processes, such as emulsion aggregation toner processes, for preparing toner compositions comprising a resin substantially free of cross linking; a cross linked resin or gel; a wax; and a colorant.

RELATED APPLICATIONS

Commonly assigned, co-pending U.S. Patent Application of Edward Graham Zwartz, T. Brian McAneney, Daryl Vanbesien, Patricia Burns, and Hwee Ng, Ser. No. 11/003,176, entitled "Toner Compositions," filed of even date herewith, which is hereby incorporated by reference herein in its entirety, describes toner compositions comprising a non cross linked resin, a cross linked resin, a wax, a pigment dispersion, and a coagulant of a poly metal halide providing a toner having selected characteristics such as excellent fusing characteristics.

Commonly assigned, co-pending U.S. Patent Application of Edward Graham Zwartz and T. Brian McAneney, Ser. No. 11/003,966, entitled "Toner Processes," filed of even date herewith, which is hereby incorporated by reference herein in its entirety, describes toner processes comprising developing an image on a document having a toner composition applied to the document, wherein the toner composition comprises a resin substantially free of cross linking, a cross linked resin, a wax, and a colorant; and wherein the developed document possesses the characteristic of resistance to adverse effects of electron beam irradiation. In embodiments, the processes further include, during fusing, migrating the wax and cross linked resin to the surface of the toner particles thereby imparting protection to the toner particles against exposure to elevated temperatures.

Commonly assigned, co-pending U.S. Patent Application of Vladislav Skorokhod, Wafa Faisul Bashir, Maria N. V. McDougall, and Shigang Steven Qiu, Ser. No. 11/003,297, entitled "Toner Compositions," filed of even date herewith, which is hereby incorporated by reference herein in its entirety, describes toner compositions comprising a non cross linked resin; a cross linked resin; a wax; and a conductive colorant, wherein the compositions have an optimized colorant loading to provide image quality in combination with alleviation or elimination of undesirable effects associated with inductive charging.

Commonly assigned, co-pending U.S. Patent Application of Maria N. V. McDougall and Richard P. N. Veregin, Ser. No. 11/003,256, entitled "Toner Compositions" filed of even date herewith, which is hereby incorporated by reference herein in its entirety, describes a toner composition comprising a binder, colorant, and a charge control surface additive mixture comprising a mixture of a first titanium dioxide possessing a first conductivity and a second titanium dioxide possessing a second conductivity and which second conductivity is dissimilar from the first conductivity; wherein the mixture of the first titanium dioxide and the second titanium dioxide is selected in a ratio sufficient to impart a selected triboelectric charging characteristic to the toner composition.

The appropriate components and process aspects of each of the foregoing may be selected for the present disclosure in embodiments thereof.

BACKGROUND

For both black and color prints, a small particle size toner is known to improve the image quality of the prints. High speed black and white printers require toner particles that can provide a matte finish in an oil-less fuser system with a low minimum fixing temperature (MFT) to enable high speed printing and at the same time achieve superior image quality in the resultant printed product.

It is known that toners containing carbon black or other conductive pigments are susceptible to inductive charging in high electric fields. As a result, a large amount of wrong-sign toner is created which leads to excessive background on the photoreceptor especially with machines employing contact dual-component development. This inductive background has low transfer efficiency and causes two fundamental problems: poor image quality due to some background toner transferring onto the media, and excessive amount of wasted toner, since most of the un-transferred background toner is directed straight to the waste bottle. Under the most severe conditions, as much as about 80% of the total toner consumed can be lost to inductive background.

U.S. Pat. No. 6,447,974 describes in the Abstract a process for the preparation of a latex polymer by (i) preparing or providing a water aqueous phase containing an anionic surfactant in an optional amount of less than or equal to about 20 percent by weight of the total amount of anionic surfactant used in forming the latex polymer; (ii) preparing or providing a monomer emulsion in water which emulsion contains an anionic surfactant; (iii) adding about 50 percent or less of said monomer emulsion to said aqueous phase to thereby initiate seed polymerization and to form a seed polymer, said aqueous phase containing a free radical initiator; and (iv) adding the remaining percent of said monomer emulsion to the composition of (iii) and heating to complete an emulsion polymerization thus forming a latex polymer.

U.S. Pat. No. 6,413,692 describes in the Abstract a process comprising coalescing a plurality of latex encapsulated colorants and wherein each of said encapsulated colorants are generated by miniemulsion polymerization.

U.S. Pat. No. 6,309,787 describes in the Abstract a process comprising aggregating a colorant encapsulated polymer particle containing a colorant with colorant particles and wherein said colorant encapsulated latex is generated by a miniemulsion polymerization.

U.S. Pat. No. 6,294,306 describes in the Abstract toners which include one or more copolymers combined with colorant particles or primary toner particles and a process for preparing a toner comprising (i) polymerizing an aqueous latex emulsion comprising one or more monomers, an optional nonionic surfactant, an optional anionic surfactant, an optional free radical initiator, an optional chain transfer agent, and one or more copolymers to form emulsion resin particles having the one or more copolymers dispersed therein; (ii) combining the emulsion resin particle with colorant to form statically bound aggregated composite particles; (iii) heating the statically bound aggregated composite particles to form toner; and (iv) optionally isolating the toner.

U.S. Pat. No. 6,130,021 describes in the Abstract a process involving the mixing of a latex emulsion containing resin and a surfactant with a colorant dispersion containing a nonionic surfactant, and a polymeric additive and adjusting the resulting mixture pH to less than about 4 by the addition of an acid and thereafter heating at a temperature below about, or equal to about, the glass transition temperature (Tg) of the latex resin, subsequently heating at a temperature above about, or about equal to, the Tg of the latex resin, cooling to about room temperature, and isolating the toner product.

U.S. Pat. No. 5,928,830 describes in the Abstract a process for the preparation of a latex comprising a core polymer and a shell thereover and wherein the core polymer is generated by (A) (i) emulsification and heating of the polymerization reagents of monomer, chain transfer agent, water, surfactant, and initiator; (ii) generating a seed latex by the aqueous emulsion polymerization of a mixture comprised of part of the (i) monomer emulsion, from about 0.5 to about 50 percent by weight, and a free radical initiator, and which polymerization is accomplished by heating, and, wherein the reaction of the free radical initiator and monomer produces a seed latex containing a polymer; (iii) heating and adding to the formed seed particles of (ii) the remaining monomer emulsion of (I), from about 50 to about 99.5 percent by weight of monomer emulsion of (i) and free radical initiator; (iv) whereby there is provided said core polymer; and (B) forming a shell thereover said core generated polymer and which shell is generated by emulsion polymerization of a second monomer in the presence of the core polymer, which emulsion polymerization is accomplished by (i) emulsification and heating of the polymerization reagents of monomer, chain transfer agent, surfactant, and an initiator; (ii) adding a free radical initiator and heating; (iii) whereby there is provided said shell polymer.

U.S. Pat. No. 5,869,558 describes in the Abstract dielectric black particles for use in electrophoretic image displays, electrostatic toner or the like, and the corresponding method of manufacturing the same. The black particles are latex particles formed by a polymerization technique, wherein the latex particles are stained to a high degree of blackness with a metal oxide.

U.S. Pat. No. 5,869,216 describes in the Abstract a process for the preparation of toner comprising blending an aqueous colorant dispersion and a latex emulsion containing resin; heating the resulting mixture at a temperature below about the glass transition temperature (Tg) of the latex resin to form toner sized aggregates; heating said resulting aggregates at a temperature above about the Tg of the latex resin to effect fusion or coalescence of the aggregates; redispersing said toner in water at a pH of above about 7; contacting the resulting mixture with a metal halide or salt, and then with a mixture of an alkaline base and a salicylic acid, a catechol, or mixtures thereof at a temperature of from about 25 degrees C. to about 80 degrees C.; and optionally isolating the toner product, washing, and drying. Additional patents of interest include U.S. Pat. Nos. 5,766,818; 5,344,738; and 4,291,111.

The disclosures of each of the foregoing U.S. patents are hereby incorporated by reference herein in their entireties. The appropriate components and process aspects of the each of the foregoing U.S. patents may be selected for the present compositions and processes in embodiments thereof.

There remains a need for an improved toner composition and process which overcomes or alleviates the above-described and other problems experienced in the art. There further remains a need for a toner composition suitable for high speed printing, particularly high speed monochrome printing that can provide excellent release and hot offset characteristics, minimum fixing temperature, and suitable small toner particle size characteristics.

SUMMARY

A toner composition and a process for preparing a toner including, for example, an emulsion aggregation process for preparing a toner, are described. The toner composition comprises, for example, a resin substantially free of cross linking; a cross linked resin; a wax; and a colorant. For example, a resin that is substantially free of cross linking (also referred to herein as a non cross linked resin) comprises a resin having substantially about zero percent cross linking to about 0.1 percent cross linking. For example, a cross linked resin comprises a cross linked resin or gel comprising, for example, about 0.3 percent cross linking to about 20 percent cross linking.

A process for preparing a toner comprises, for example, mixing a resin substantially free of cross linking and a cross-linked resin in the presence of a wax, a colorant, and a coagulant to provide toner size aggregates; adding additional resin substantially free of cross linking to the formed aggregates thereby providing a shell over the formed aggregates; heating the shell covered aggregates to form toner; and, optionally, isolating the toner. In embodiments, the heating comprises a first heating below the glass transition temperature of the resin substantially free of cross linking and a second heating above the glass transition temperature of the resin substantially free of cross linking. In embodiments, the toner process comprises providing an anionic surfactant in an amount of for example about 0.01% to about 20% by weight based upon a total weight of the reaction mixture, wherein the anionic surfactant is selected for example from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof. In embodiments, the toner process provides a shell having a thickness of for example about 0.3 to about 0.8 micrometers.

The toners generated with the present processes are especially useful for imaging processes, especially xerographic processes. The toners advantageously provide characteristics which meet reprographic machine requirements such as minimum fixing temperature, wide fusing latitude, good release, low gloss, robust particles, triboelectrical properties, and development at high speeds such as speeds of about 150 ppm and above.

These and other features and advantages will be more fully understood from the following description of certain specific embodiments taken together with the accompanying claims.

DESCRIPTION

Toner compositions will now be described comprising a non cross linked resin; a cross linked resin or gel; and a colorant; and a process for preparing a toner comprising mixing a non cross linked resin and a cross linked resin in the presence of a wax, a colorant, and a coagulant to provide toner size aggregates; adding additional non cross linked latex to the formed aggregates thereby providing a shell over the formed aggregates; heating the shell covered aggregates to form toner; and, optionally, isolating the toner. In embodiments, the toner process includes providing an anionic surfactant in an amount of for example about 0.01% to about 20% by weight based upon a total weight of the reaction mixture; wherein for example the anionic surfactant is selected from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof. In further embodiments, the shell thus formed has, for example, a thickness of about 0.3 to about 0.8 micrometers.

Latex Resins or Polymers

Illustrative examples of latex resins or polymers selected for the non cross linked resin and cross linked resin or gel include, but are not limited to, styrene acrylates, styrene methacrylates, butadienes, isoprene, acrylonitrile, acrylic acid, methacrylic acid, beta-carboxy ethyl arylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. In embodiments, the resin or polymer is a styrene/butyl acrylate/carboxylic acid terpolymer. In embodiments, at least one of the resin substantially free of cross linking and the cross linked resin comprises carboxylic acid in an amount of about 0.05 to about 10 weight percent based upon the total weight of the resin substantially free of cross linking or cross linked resin.

Non Cross Linked Resin

In embodiments, the resin that is substantially free of cross linking (also referred to herein as a non cross linked resin) comprises a resin having less than about 0.1 percent cross linking. For example, the non cross linked latex comprises in embodiments styrene, butylacrylate, and beta-carboxy ethyl acrylate (beta-CEA) monomers, although not limited to these monomers, termed herein as monomers A, B, and C, prepared, for example, by emulsion polymerization in the presence of an initiator, a chain transfer agent (CTA), and surfactant.

In embodiments, the resin substantially free of cross linking comprises styrene:butylacrylate:beta-carboxy ethyl acrylate wherein, for example, the non cross linked resin monomers are present in an amount of about 70% to about 90% styrene, about 10% to about 30% butylacrylate, and about 0.05 parts per hundred to about 10 parts per hundred beta-CEA, or about 3 parts per hundred beta-CEA, by weight based upon the total weight of the monomers, although not limited. For example, the carboxylic acid can be selected, for example, from the group comprised of, but not limited to, acrylic acid, methacrylic acid, itaconic acid, beta carboxy ethyl acrylate (beta CEA), fumaric acid, maleic acid, and cinnamic acid.

In a feature herein, the non cross linked resin comprises about 73% to about 85% styrene, about 27% to about 15% butylacrylate, and about 1.0 part per hundred to about 5 parts per hundred beta-CEA, by weight based upon the total weight of the monomers although the compositions and processes are not limited to these particular types of monomers or ranges. In another feature, the non cross linked resin comprises about 81.7% styrene, about 18.3% butylacrylate and about 3.0 parts per hundred beta-CEA by weight based upon the total weight of the monomers.

The initiator may be, for example, but is not limited to, sodium, potassium or ammonium persulfate and may be present in the range of, for example, about 0.5 to about 3.0 percent based upon the weight of the monomers, although not limited. The CTA may be present in an amount of from about 0.5 to about 5.0 percent by weight based upon the combined weight of the monomers A and B, although not limited. In embodiments, the surfactant is an anionic surfactant present in the range of about 0.7 to about 5.0 percent by weight based upon the weight of the aqueous phase, although not limited to this type or range.

For example, the monomers are polymerized under starve fed conditions as referred to in Xerox patents such as U.S. Pat. Nos. 6,447,974, 6,576,389, 6,617,092, and 6,664,017, which are hereby incorporated by reference herein in their entireties, to provide latex resin particles having a diameter in the range of about 100 to about 300 nanometers.

For example, the molecular weight of the non cross linked latex resin is from about 30,000 to about 37,000, preferably about 34,000, although not limited to this range.

In embodiments, the onset glass transition temperature (TG) of the non cross linked resin is in the range of, for example, from about 46° C. to about 62° C., or about 58° C., although not limited.

In embodiments, the amount of carboxylic acid groups is selected in the range of about 0.04 to about 4.0 pph of the resin monomers A and B, although not limited.

In embodiments, the molecular number (Mn) is from about 5000 to about 20,000, or about 11,000.

In embodiments, the prepared non cross linked latex resin has a pH of about 1.0 to about 4.0, or about 2.0.

Cross Linked Resin or Gel

For example, a cross linked latex is prepared from a non cross linked latex comprising styrene, butylacrylate, beta-CEA, and divinyl benzene, termed herein as monomers A, B, C, and D, by emulsion polymerization, in the presence of an initiator such as a persulfate, a CTA, and a surfactant. In embodiments, the cross linked resin monomers are present in a ratio of about 60% to about 75% styrene, about 40% to about 25% butylacrylate, about 3 parts per hundred to about 5 parts per hundred beta-CEA, and about 3 parts per hundred to about 5 parts per hundred divinyl benzene, although not limited to these particular types of monomers or ranges.

In embodiments, the monomer composition may comprise, for example, about 65% styrene, 35% butylacrylate, 3 parts per hundred beta-CEA, and about 1 parts per hundred divinyl benzene, although the composition is not limited to these amounts.

In embodiments, the Tg (onset) of the cross linked latex is about 40° C. to about 55° C. or about 42° C.

In embodiments, the degree of cross linking is in the range of about 0.3 percent to about 20 percent, although not limited thereto, since an increase in the divinyl benzene concentration will increase the cross linking.

In embodiments, the soluble portion of the cross linked latex has a molecular weight (Mw) of about 135,000 and a molecular number (Mn) of about 27,000, but is not limited thereto.

In embodiments, the particle diameter size of the cross linked latex is about 20 to about 250 nanometers or about 50 nanometers, although not limited.

The surfactant may be any surfactant, such as for example a nonionic surfactant or an anionic surfactant, such as, but not limited to, Neogen RK or Dowfax, both commercially available.

In embodiments, the pH is about 1.5 to about 3.0 or about 1.8.

In embodiments, the latex particle size can be, for example, from about 0.05 micron to about 1 micron in average volume diameter as measured by the Brookhaven nanosize particle analyzer. Other sizes and effective amounts of latex particles may be selected in embodiments.

The latex resins selected for the present process are prepared, for example, by emulsion polymerization methods, and the monomers utilized in such processes preferably include the monomers listed above, such as, styrene, acrylates, methacrylates, butadiene, isoprene, acrylonitrile, acrylic acid, and methacrylic acid, and beta CEA. Known chain transfer agents, for example dodecanethiol, in effective amounts of, for example, from about 0.1 to about 10 percent, and/or carbon tetrabromide in effective amounts of from about 0.1 to about 10 percent, can also be employed to control the resin molecular weight during the polymerization.

Other processes of obtaining resin particles of from, for example, about 0.05 micron to about 1 micron can be selected from polymer microsuspension process, such as the processes disclosed in U.S. Pat. No. 3,674,736, the disclosure of which is totally incorporated herein by reference, polymer solution microsuspension processes, such as disclosed in U.S. Pat. No. 5,290,654, the disclosure of which is totally incorporated herein by reference, mechanical grinding processes, or other known processes.

Surfactants

For example, surfactants in amounts of, for example, about 0.01 to about 20, or about 0.1 to about 15 weight percent of the reaction mixture in embodiments include, for example, nonionic surfactants such as dialkylphenoxypoly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. For example, an effective concentration of the nonionic surfactant is in embodiments, for example, about 0.01 percent to about 10 percent by weight, or about 0.1 percent to about 5 percent by weight of the reaction mixture.

Examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN R.™, NEOGEN SC.™, available from Kao, Dowfax 2A1 (hexa decyldiphenyloxide disulfonate) and the like, among others. For example, an effective concentration of the anionic surfactant generally employed is, for example, about 0.01 percent to about 10 percent by weight, or about 0.1 percent to about 5 percent by weight of the reaction mixture Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R.™, NEOGEN SC™ available from Kao, and the like, among others. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-72™, IGEPAL CO-890™, IGEPAL CO-720™, IGEPAL CO-290™, IGEPAL CA-210™, ANTAROX 890™ and ANTAROX 897™. For example, an effective amount of the anionic or nonionic surfactant generally employed as an aggregate size stabilization agent is, for example, about 0.01 percent to about 10 percent or about 0.1 percent to about 5 percent, by weight of the reaction mixture.

Examples of the acids that can be utilized include, for example, nitric acid, sulfuric acid, hydrochloric acid, acetic acid, citric acid, trifluro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Wax

For example, wax suitable for the present toner compositions include, but are not limited to, alkylene waxes such as alkylene wax having about 1 to about 25 carbon atoms, polyethylene, polypropylene or mixtures thereof. The wax is present, for example, in an amount of about 6% to about 15% by weight based upon the total weight of the composition. Examples of waxes include those as illustrated herein, such as those of the aforementioned co-pending applications, polypropylenes and polyethylenes commercially available from Allied Chemical and Petrolite Corporation, wax emulsions available from Michaelman Inc. and the Daniels Products Company, Epolene N-15™ commercially available from Eastman Chemical Products, Inc., Viscol 550-P™, a low weight average molecular weight polypropylene available from Sanyo Kasei K. K., and similar materials. The commercially available polyethylenes possess, it is believed, a molecular weight (Mw) of about 1,000 to about 5,000, and the commercially available polypropylenes are believed to possess a molecular weight of about 4,000 to about 10,000. Examples of functionalized waxes include amines, amides, for example Aqua Superslip 6550™, Superslip 6530™available from Micro Powder Inc., fluorinated waxes, for example Polyfluo 190™, Polyfluo 200™, Polyfluo 523XF™, Aqua Polyfluo 411™, Aqua Polysilk 19™, Polysilk 14™ available from Micro Powder Inc., mixed fluorinated, amide waxes, for example Microspersion 19™ also available from Micro Powder Inc., imides, esters, quaternary amines, carboxylic acids or acrylic polymer emulsion, for example Joncryl 74™, 89™, 130™, 537™, and 538™, all available from SC Johnson Wax, chlorinated polypropylenes and polyethylenes available from Allied Chemical and Petrolite Corporation and SC Johnson Wax.

In embodiments, the wax comprises a wax in the form of a dispersion comprising, for example, a wax having a particle diameter of about 100 nanometers to about 500 nanometers, water, and an anionic surfactant. In embodiments, the wax is included in amounts such as about 6 to about 15 weight percent. In embodiments, the wax comprises polyethylene wax particles, such as Polywax 850, commercially available from Baker Petrolite, although not limited thereto, having a particle diameter in the range of about 100 to about 500 nanometers, although not limited. The surfactant used to disperse the wax is an anionic surfactant, although not limited thereto, such as, for example, Neogen RK™commercially available from Kao Corporation or TAYCAPOWER BN2060 commercially available from Tayca Corporation.

Pigment/Colorant

For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 1% to about 25% by weight based upon the total weight of the composition. It is to be understood that other useful colorants will become readily apparent to one of skill in the art based on the present disclosures.

In general, useful colorants include, but are not limited to, Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SEIGLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

Coagulant

In a featured emobodiment, the coagulants used in the present process comprise poly metal halides, such as polyaluminum chloride (PAC) or polyaluminum sulfo silicate (PASS). For example, the coagulants provide a final toner having a metal content of, for example, about 400 to about 10,000 parts per million. In another feature, the coagulant comprises a poly aluminum chloride providing a final toner having an aluminum content of about 400 to about 10,000 parts per million Toner Particle Preparation For example, emulsion/aggregation/coalescing processes for the preparation of toners are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox patents U.S. Pat. Nos. 6,627,373; 6,656, 657; 6,617,092; 6,638,677; 6,576,389; 6,664,017; 6,656,658; and 6,673,505 are each hereby totally incorporated herein by reference. The appropriate components and process aspects of each of the foregoing U.S. Patents may be selected for the present composition and process in embodiments thereof.

In embodiments thereof, the toner process comprises forming a toner particle by mixing the non cross linked latex with a quantity of the cross linked latex in the presence of a wax and a pigment dispersion to which is added a coagulant of a poly metal halide such as polyaluminum chloride while blending at high speeds such as with a polytron. The resulting mixture having a pH of about 2.0 to about 3.0 is aggregated by heating to a temperature below the resin Tg to provide toner size aggregates. Additional non cross linked latex is added to the formed aggregates providing a shell over the formed aggregates. The pH of the mixture is then changed by the addition of a sodium hydroxide solution until a pH of about 7.0 is achieved. When the mixture reaches a pH of about 7.0, the carboxylic acid becomes ionized to provide additional negative charge on the aggregates thereby providing stability and preventing the particles from further growth or an increase in the size distribution when heated above the Tg of the latex resin. The temperature of the mixture is then raised to about 95° C. After about 30 minutes, the pH of the mixture is reduced to a value sufficient to coalesce or fuse the aggregates to provide a composite particle upon further heating such as about 4.5. The fused particles are measured for shape factor or circularity, such as with a Sysmex FPIA 2100 analyzer, until the desired shape is achieved.

The mixture is allowed to cool to room temperature and is washed. A first wash is conducted such as at a pH of about 10 and a temperature of about 63° C. followed by a deionized water (DIW) wash at room temperature. This is followed by a wash at a pH of about 4.0 at a temperature of about 40° C. followed by a final DIW water wash. The toner is then dried.

While not wishing to be bound by theory, in the present toner composition comprising a non cross linked latex, a cross linked latex, a wax, and a colorant, the cross linked latex is primarily used to increase the hot offset, while the wax is used to provide release characteristics. The ratio of the non cross linked latex to the cross linked latex, the wax content and the colorant content are selected to control the rheology of the toner.

In embodiments, the toner comprises non cross linked resin, cross linked resin or gel, wax, and colorant in an amount of about 68% to about 75% non cross linked resin, about 6% to about 13% cross linked resin or gel, about 6% to about 15% wax, and about 7% to about 13% colorant, by weight based upon the total weight of the composition wherein a total of the components is about 100%, although not limited thereto. In embodiments, the non cross linked resin, the cross linked resin or gel, the wax, and the colorant are present in an amount of about 71% non cross linked resin, about 10% cross linked resin or gel, about 9% wax, and about 10% colorant, by weight based upon the total weight of the composition.

In embodiments, the toner composition comprises a Mw in the range of about 25,000 to about 40,000 or about 35,000, a Mn in the range of about 9,000 to about 13,000 or about 10,000, and a Tg (onset) of about 48° C. to about 62° C. or about 54° C.

In embodiments of the present toner composition, the resultant toner possesses a shape factor of about 120 to about 140, and a particle circularity of about 0.930 to about 0.980.

Composite Toner Particle

In embodiments, the colorant comprises a black pigment such as carbon black. In yet another embodiment, the colorant is a pigment comprising black toner particles having a shape factor of about 120 to about 140 where a shape factor of 100 is considered to be spherical and a circularity of about 0.900 to about 0.980 as measured on an analyzer such as a Sysmex FPIA 2100 analyzer, where a circularity of 1.00 is considered to be spherical in shape.

In another feature, the colorant comprises a pigment dispersion, comprising pigment particles having a volume average diameter of about 50 to about 300 nanometers, water, and an anionic surfactant. For example, the colorant may comprise carbon black pigment dispersion such as with Regal 300 commercially available, prepared in an anionic surfactant and optionally a non-ionic dispersion to provide pigment particles having a size of from about 50 nanometers to about 300 nanometers. In embodiments, the surfactant used to disperse the carbon black is an anionic surfactant such as Neogen RK™, or TAYCAPOWDER BN 2060, although not limited thereto. Preferably, an ultimizer type equipment is used to provide the pigment dispersion, although media mill or other means can also be used.

Optionally, other various known colorants such as dyes or pigments may be present in the toner and the toner can optionally be used as an additional color in the xerographic engine besides black and is selected in an effective amount of, for example, from about 1 to about 65 percent by weight based upon the weight of the toner composition, in an amount of from about 1 to about 15 percent by weight based upon the weight of the toner composition, or in an amount of from about 3 to about 10 percent by weight, for example.

The following examples are set forth as representative of the present disclosure. These examples are not to be construed as limiting the scope of the disclosure as these and other equivalent embodiments will be apparent in view of the present disclosure and accompanying claims.

EXAMPLES

Preparation of Non Cross Linked Latex by Emulsion Polymerization

A latex emulsion designated as EP5 comprising polymer particles generated from the emulsion polymerization of styrene, n-butyl acrylate, and beta-CEA was prepared as follows. A surfactant solution consisting of about 605 grams Dowfax 2A1 anionic emulsifier and about 387 kg deionized water was prepared by mixing for about 10 minutes in a stainless steel holding tank. The holding tank was then purged with nitrogen for about 5 minutes before transferring into a reactor. The reactor was then continuously purged with nitrogen while being stirred at about 100 rpm. The reactor was then heated to about 80° C. at a controlled tare and held at 80° C. for about 2 hrs. Separately, about 6.1 kg of ammonium persulfate initiator was dissolved in about 30.2 kg of deionized water. The monomer emulsion was prepared separately as follows. About 311.4 kg of styrene, about 95.6 kg of butyl acrylate, about 12.21 kg of beta-CEA, about 2.88 kg of 1-dodecanethiol, about 1.42 kg of ADOD (1,10-decanediol diacrylate), about 8.04 kg of Dowfax 2A1 anionic surfactant, and about 193 kg of deionized water were mixed to form an emulsion. About 1% of the formed emulsion was then slowly fed into the reactor containing the aqueous surfactant phase at about 80° C. to form the seeds while being purged with nitrogen. The initiator solution was then slowly charged into the reactor. After about 10 minutes, the rest of the emulsion was continuously fed into the reactor using a metering pump at a rate of about 0.5 milliliters/minute. Once all of the monomer emulsion was charged into the main reactor, the temperature was held at about 80° C. for an additional 2 hours to complete the reaction. Full cooling was then applied and the reactor temperature was reduced to about 35° C. The resultant product was collected into a holding tank and then dried. The molecular properties of the latex after drying were as follows: Mw=about 35,419; Mn=about 11,354; onset Tg=about 51.0° C.

Preparation of Cross Linked Latex by Emulsion Polymerization

A latex emulsion designated EA15-8 comprising polymer gel particles generated from the semi-continuous emulsion polymerization of styrene, n-butyl acrylate, divinyl benzene, and beta-CEA was prepared as follows. A surfactant solution consisting of about 1.75 kilograms Neogen RK™ anionic emulsifier and about 145.8 kilograms deionized water was prepared by mixing for about 10 minutes in a stainless steel holding tank. The holding tank was then purged with nitrogen for about 5 minutes before transferring into the reactor. The reactor was then continuously purged with nitrogen while being stirred at about 300 rpm. The reactor was then heated to a temperature of about 76° C. at a controlled rate and held constant. In a separate container, about 1.24 kilograms of ammonium persulfate initiator was dissolved in about 13.12 kilograms of deionized water. In a second separate container, the monomer emulsion was prepared as follows. About 47.39 kilograms of styrene, about 25.52 kilograms of n-butyl acrylate, about 2.19 kilograms of beta-CEA, and about 729 grams of 55% grade divinyl benzene, about 4.08 kilograms of Neogen RK anionic surfactant, and about 78.73 kilograms of deionized water were mixed to form an emulsion. The ratio of styrene monomer to n-butyl acrylate monomer was about 65 to about 35 percent by weight. About 1% of the formed emulsion was slowly fed into the reactor containing the aqueous surfactant phase at about 76° C. under nitrogen purge to form seeds. The initiator solution was then slowly charged into the reactor and allowed to rest for about 20 minutes. After about 20 minutes rest, the remainder of the emulsion was continuously fed into the reactor using metering pumps. Once all of the monomer emulsion was charged into the main reactor, the temperature was held at about 76° C. for an additional 2 hours to complete the reaction. Full cooling was then applied and the reactor temperature was reduced to about 35° C. The product was collected into a holding tank after filtering through a 1 micron filter pad. After drying a portion of the latex, the molecular properties were measured to be as follows: Mw=about 134,700; Mn=about 27,300; onset Tg=about 43° C. The average particle size of the latex as measured with a Disc Centrifuge was about 48 nanometers. The residual monomer as measured by gas chromatography was less than about 50 parts per million for styrene and less than about 100 parts per million for n-butyl acrylate.

Preparation of Toner

About 186.1 grams of EP5 latex having a solids loading of about 41.4 weight % and about 55.22 grams of wax emulsion (Polywax 850®) having a solids loading of about 30.07 weight % were added to about 492.8 grams of deionized water in a vessel and stirred using an IKA Ultra Turrax®T50 homogenizer operating at about 4,000 rpm. Thereafter, about 113.5 grams of black pigment dispersion Sun Pigment WA 1945 (Regal 330) having a solids loading of about 17 weight %, about 75 grams of EA15-8 latex gel having a solids loading of 24 weight %, was added to the above mixture followed by drop-wise addition of about 30.6 grams of a flocculent mixture containing about 3.06 grams polyaluminum chloride mixture and about 27.54 grams of a 0.02 molar (M) nitric acid solution. As the flocculent mixture was added drop-wise, the homogenizer speed was increased to about 5,200 rpm and homogenized for an additional 5 minutes. Thereafter, the mixture was heated at a 1° C. per minute temperature increase to a temperature of about 49° C. and held there for a period of about 1.5 to about 2 hours resulting in a volume average particle diameter of about 5 microns as measured with a Coulter Counter. During the heat up period, the stirrer was run at about 250 rpm. About 10 minutes after the set temperature of 49° C. was reached, the stirrer speed was reduced to about 220 rpm. An additional 121.2 grams of EP5 latex was added to the reactor mixture and allowed to aggregate for an additional period of about 30 minutes at about 49° C. resulting in a volume average particle diameter of about 5.7 microns. The pH of the reactor mixture was adjusted to about 7 with a 1.0 M sodium hydroxide solution. The reactor mixture was then heated at a temperature increase of about 1° C. per minute to a temperature of about 95° C. The pH of the mixture was then adjusted to about 3.7 with a 0.3 M nitric acid solution. The reactor mixture was then gently stirred at about 95° C. for about 5 hours to coalesce and spherodize the particles. The reactor heater was then turned off and the mixture was allowed to cool to room temperature at a rate of about 1° C. per minute. The resultant toner mixture was comprised of about 16.7% toner, about 0.25% anionic surfactant, and about 82.9% water by weight. The toner of this mixture comprised about 71 weight % styrene/acrylate non cross linked polymer, about 10 weight % EA15-8 cross linked polymer or gel, about 10 weight % Regal 330 pigment, about 9 weight % PW850 wax, and had a volume average particle diameter of about 5.7 microns, and a grain size distribution (GSD) of about 1.19. The particles were washed 6 times, the first wash being conducted at pH of about 10 at about 63° C., followed by 3 washes with deionized water at room temperature, followed by one wash at a pH of about 4.0 at about 40° C., and a final wash with deionized water at room temperature.

The Theological parameters of the toner were obtained with a stress rheometer, SR5000 available from Rheometrics. The process of measurement of tan delta comprising preparing a homogeneous disc from 1 gram of toner at a temperature of about 75° C. and a pressure of about 1,000 pounds per square inch (psi), the disk having a size of about 25 millimeters in diameter and about 2 millimeters thick. The disc was placed between two parallel plates 25 millimeters in diameter and was subjected to a dynamic temperature step test (Step test comprising a step change of temperature where the temperature is allowed to equilibrate at the set temperature where the viscosity, G' and G" is measured, after which the temperature is stepped up to the next set temperature and the same set of measurements are performed). The measurements were performed at a constant frequency of 1 Hz and a constant stress of 500 Pascal. Elastic G' and viscous G" modulii were measured at three temperatures, about 130° C., about 140° C. and about 150° C. From G' and G", Tan. delta at each temperature is calculated using the formula $$\text{Tan delta}=G''/G'$$

At the frequency of 1 Hz and stress of 500 Pascal, the toner was characterized as having a tan delta of 0.63 to 0.90 at 150° C. to 130° C. In embodiments, toner is characterized as possessing an elastic storage modulus (G') of 44000 at 110° C. In further embodiments, the toner is characterized as having an elastic storage modulus of 5000 at 150° C.

In further embodiments, developer compositions are prepared by mixing the toners obtained with the present processes with known carrier particles, including coated carriers, such as steel, ferrites, and the like, reference U.S. Pat. Nos. 4,937,166 and 4,935,326, the disclosures of which are totally incorporated herein by reference, using, for example from about 2 percent toner concentration to about 8 percent toner concentration. In embodiments, the carriers selected may also contain dispersed in the polymer coating a conductive compound, such as a conductive carbon black and which conductive compound is present in various suitable amounts, such as from about 15 to about 65, or about 20 to about 45, weight percent.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A toner composition comprising:

a resin substantially free of cross linking;

a cross linked resin;

a wax; and a colorant;

wherein the composition comprises about 68% to about 75% resin substantially free of cross linking, about 6% to about 13% cross linked resin, about 6% to about 15% wax, and about 7% to about 13% colorant, by weight based upon the total weight of the composition and wherein a total of the components is about 100%; and wherein at least one of the resin substantially free of cross linking and the cross linked resin comprises a styrene acrylate copolymer.

2. The toner composition of claim 1, comprising about 71% resin substantially free of cross linking, about 10% cross linked resin, about 9% wax and about 10% colorant, by weight based upon the total weight of the composition and wherein a total of the components is about 100%.

3. The toner composition of claim 1, possessing a tan delta of 0.63 to 0.90 at 150° C. to 130° C.

4. The toner composition of claim 1, possessing an elastic storage modulus (G') of 44000 at 110° C.

5. The toner composition of claim 1, possessing an elastic storage modulus of 5000 at 150° C.

6. The toner composition of claim 1, possessing a shape factor of about 120 to about 140.

7. The toner composition of claim 1, possessing a circularity of about 0.930 to about 0.980.

8. The toner composition of claim 1, wherein the resin substantially free of cross linking comprises a resin having substantially about zero percent cross linking to about 0.1 percent cross linking.

9. The toner composition of claim 1, wherein the resin substantially free of cross linking and the cross linked resin are selected from the group consisting of styrene acrylates, styrene methacrylates, butadienes, isoprene, acrylonitrile, acrylic acid, methacrylic acid, beta-carboxy ethyl acrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and styrene/butyl acrylate/carboxylic acid terpolymers, or a mixture thereof.

10. The toner composition of claim 1, wherein the resin substantially free of cross linking comprises styrene:butylacrylate:beta-carboxy ethyl acrylate.

11. The toner composition of claim 1, wherein the resin substantially free of cross linking comprises about 70% to about 90% styrene, about 10% to about 30% butylacrylate, and about 0.5 parts per hundred to about 10 parts per hundred beta-carboxy ethyl acrylate, by weight based upon the total weight of the resin substantially free of cross linking.

12. The toner composition of claim 1, wherein the resin substantially free of cross linking comprises about 73% to about 85% styrene, about 15% to about 27% butylacrylate, and about 1.0 part per hundred to about 5 part per hundred beta-carboxy ethyl acrylate, by weight based upon the total weight of the resin substantially free of cross linking.

13. The toner composition of claim 1, wherein the resin substantially free of cross linking comprises about 81.7% styrene, about 18.3% butylacrylate, and about 3 parts per hundred beta-carboxy ethyl acrylate, by weight based upon the total weight of the resin substantially free of cross linking.

14. The toner composition of claim 1, wherein the cross linked resin comprises styrene:butylacrylate:beta-carboxy ethyl acrylate:divinyl benzene.

15. The toner composition of claim 1, wherein the cross linked resin comprises about 60% to about 75% styrene, about 40% to about 25% butylacrylate, about 3 parts per hundred to about 5 parts per hundred beta-carboxy ethyl acrylate, and about 3 parts per hundred to about 5 parts per hundred divinyl benzene, by weight based upon the total weight of the cross linked resin.

16. The toner composition of claim 1, wherein the cross linked resin comprises about 65% styrene, about 35% butylacrylate, about 3 parts per hundred beta-carboxy ethyl acrylate, and about 1 part per hundred divinyl benzene, by weight based upon the total weight of the cross linked resin.

17. A toner comprising the toner composition of claim 1, possessing a metal content in an amount of about 400 to about 10,000 parts per million.

18. A toner comprising the toner composition of claim 1, possessing an aluminum content in an amount of about 400 to about 10,000 parts per million.

19. The toner composition of claim 1, wherein the wax is an alkylene wax present in an amount of about 6% to about 15% by weight based upon the total weight of the composition.

20. The toner composition of claim 1, wherein the wax is an alkylene, a polyethylene, a polypropylene, or mixtures thereof.

21. The toner composition of claim 1, wherein the wax is in the form of a dispersion comprising a wax having a particle diameter of about 100 to about 500 nanometers, water, and an anionic surfactant.

22. The toner composition of claim 1, wherein the colorant comprises a pigment, a dye, carbon black, magnetite, black, cyan, magenta, yellow, red, green, blue, brown, or mixtures thereof, in an amount of about 1% to about 25% by weight based upon the total weight of the composition.

23. The toner of claim 1, wherein the colorant comprises a pigment dispersion comprising pigment particles having a volume average diameter of about 50 to about 300 nanometers, water, and an anionic surfactant.

24. The toner composition of claim 1, wherein at least one of the resin substantially free of cross linking and the cross linked resin comprises carboxylic acid in an amount of about 0.05 to about 10 weight percent based upon the total weight of the resin substantially free of cross linking or cross linked resin.

25. The toner composition of claim 1, wherein the colorant comprises a black pigment.

* * * * *